US011158285B2

(12) United States Patent
Mizoguchi

(10) Patent No.: US 11,158,285 B2
(45) Date of Patent: Oct. 26, 2021

(54) COLOR CONVERSION PROCESSOR, CONTROL METHOD THEREOF AND STORAGE MEDIUM

(71) Applicant: CANON KABUSHIKI KAISHA, Tokyo (JP)

(72) Inventor: Masahiko Mizoguchi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/243,571

(22) Filed: Jan. 9, 2019

(65) Prior Publication Data

US 2019/0221188 A1 Jul. 18, 2019

(30) Foreign Application Priority Data

Jan. 15, 2018 (JP) ..... JP2018-004340
Dec. 25, 2018 (JP) ..... JP2018-241351

(51) Int. Cl.
*G09G 5/04* (2006.01)
*G09G 5/10* (2006.01)
*G09G 5/06* (2006.01)

(52) U.S. Cl.
CPC ..... *G09G 5/04* (2013.01); *G09G 5/06* (2013.01); *G09G 5/10* (2013.01);
(Continued)

(58) Field of Classification Search
CPC ..... G09G 5/04; G09G 5/06; G09G 5/10
See application file for complete search history.

(56) References Cited

U.S. PATENT DOCUMENTS

2003/0020974 A1* 1/2003 Matsushima ..... G06T 5/008 358/521
2007/0013622 A1* 1/2007 Stoops ..... G09G 3/3611 345/84

(Continued)

FOREIGN PATENT DOCUMENTS

JP 2006148605 A * 6/2006
JP 2008271248 A 11/2008

OTHER PUBLICATIONS

Aihara, JP-2006148605-A English Translation, pp. 1-8 (Year: 2006).*

*Primary Examiner* — Samantha (Yuehan) Wang
(74) *Attorney, Agent, or Firm* — Carter, DeLuca & Farrell LLP

(57) ABSTRACT

An object of the present invention is to reduce computation for color conversion processing on input RGB color signals with maintaining the hue of a picture expressed by the input RGB color signals. A color conversion processor of the present invention includes: a conversion unit that converts color data including multiple color components, which can be displayed in a first color gamut, to corresponding color data in a second color gamut, which is narrower than the first color gamut; a first color correction unit that corrects the converted color data by using a first color correction value; a first derivation unit that derives a first luminance correction value by multiplication using the first color correction value; and a first luminance correction unit that corrects the color data, corrected by the first color correction unit, by using the first luminance correction value.

18 Claims, 11 Drawing Sheets

(52) U.S. Cl.
CPC ..... *G09G 2320/0242* (2013.01); *G09G 2320/0276* (2013.01); *G09G 2320/0666* (2013.01); *G09G 2340/06* (2013.01)

(56) References Cited

U.S. PATENT DOCUMENTS

| | | | | |
|---|---|---|---|---|
| 2007/0171421 | A1* | 7/2007 | Ochi | G01J 3/46 356/402 |
| 2008/0068405 | A1* | 3/2008 | Kumakura | G09G 3/2944 345/690 |
| 2009/0304274 | A1* | 12/2009 | Yoshii | G09G 5/02 382/167 |
| 2011/0293147 | A1* | 12/2011 | Utsumi | G06T 7/254 382/107 |
| 2014/0218386 | A1* | 8/2014 | Tatsuno | G09G 3/3607 345/590 |
| 2018/0205919 | A1* | 7/2018 | Nakagawa | H04N 9/3164 |

* cited by examiner

COLOR CONVERSION PROCESSOR, CONTROL METHOD THEREOF AND STORAGE MEDIUM

BACKGROUND OF THE INVENTION

Field of the Invention

The present invention relates to a color conversion processor and a control method thereof.

Description of the Related Art

Recently, there have been increasing image display devices each provided with a display panel (e.g., liquid crystal panel, plasma display panel, organic EL panel, and so on) having a wider displayable color range (hereinafter also referred to as "color gamut") than that of conventional display panels. The color gamuts have been defined by various standards; for example, BT2020 and BT709 have been respectively known as a wide color gamut standard and a narrow color gamut standard. When a color signal exceeding the displaying capability of the display panel is inputted, such an image display device attenuates the color signal exceeding the displaying capability and performs color conversion processing for adapting the color signal to the dynamic range of the display panel.

When only some parts of color signal values of RGB color signals exceed the acceptable value and only these parts of the color signal values are clipped within the acceptable value range, a ratio of the RGB color signal values is changed. As a result, the hue of a picture expressed by input RGB color signals and the hue of a picture expressed by output RGB color signals may be different from each other. In order to solve such a problem, a color signal converter of Japanese Patent Laid-Open No. 2008-271248 (PTL 1) performs offset processing using the minimum color signal value detected from the RGB color signal values and gain adjustment using a luminance correction value derived from the RGB color signal values. With such a configuration, the color signal converter of PTL 1 can perform color conversion processing to adapt color signals to the color gamut of a display panel while maintaining the hue and luminance of a picture expressed by input RGB color signals.

SUMMARY OF THE INVENTION

However, the color conversion technique disclosed in PTL 1 has a problem of an increase in computation. More specifically, the color conversion processing on input RGB color signals with maintaining the hue and the luminance of the picture expressed by the input RGB color signals additionally involves computation for especially preventing change of the luminance.

The present invention has been made in view of the above problem and has an object to reduce computation for color conversion processing on input RGB color signals with maintaining the hue of a picture expressed by the input RGB color signals.

A color conversion processor of the present invention includes: a conversion unit that converts color data including a plurality of color components, which are displayable in a first color gamut, to corresponding color data in a second color gamut, which is narrower than the first color gamut; a first color correction unit that corrects the converted color data by using a first color correction value; a first derivation unit that derives a first luminance correction value by multiplication using the first color correction value; and a first luminance correction unit that corrects the color data, corrected by the first color correction unit, by using the first luminance correction value.

Further features of the present invention will become apparent from the following description of exemplary embodiments with reference to the attached drawings.

DESCRIPTION OF THE EMBODIMENTS

Hereinafter, embodiments of the present invention are described with reference to the drawings. It should be noted that configurations described in the embodiments are only examples and are not intended to limit the range of the present invention to those configurations.

(Configuration Example of Image Signal Converter)

Figure 1:
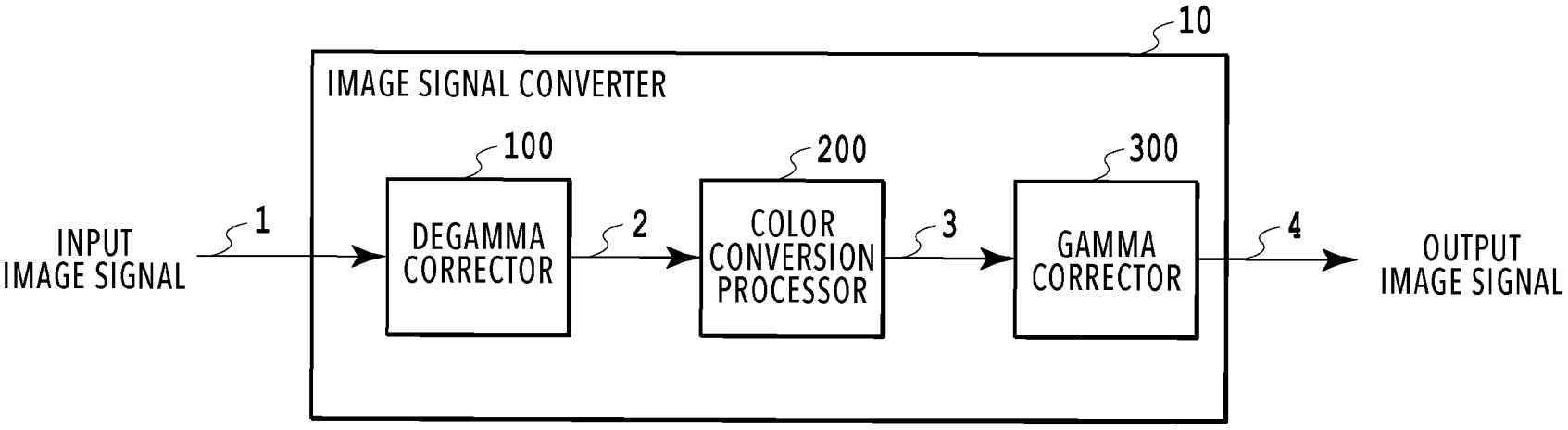
FIG. 1 is a block diagram that illustrates a configuration example of an image signal converter of an embodiment.

FIG. 1 is a block diagram that illustrates a configuration example of an image signal converter 10 to which a color conversion processor 200 of this embodiment is applicable. The image signal converter 10 of this embodiment includes a degamma corrector 100, the color conversion processor 200, and a gamma corrector 300.

An input image signal 1 is compatible with the HDR standard, for example, and the gamma standard thereof is ST2084 while the color standard thereof is BT2020. On the other hand, an output image signal 4 is compatible with the SDR standard, for example, and the gamma standard thereof is gamma 2.2 while the color standard thereof is BT709. The image signal converter 10 performs conversion processing on both or either of the gamma standard and the color standard of the input image signal 1. Image signals used by the image signal converter 10 are image signals that indicate values of multiple color components (in specific, RGB).

The degamma corrector 100 performs correction of the inverse-gamma properties on the gamma standard of the input image signal 1 and outputs luminance-linear RGB gradation data obtained by the correction as color conversion input data 2 (pre-color-converted data). Here, the term, luminance-linear, means that the relationship between gradation data and luminance expressed by the gradation data is linear. An example in which multiple color components are RGB is described; however, the embodiment is not limited thereto.

The color conversion processor 200 converts the color standard of the luminance-linear color conversion input data 2 from, for example, BT2020 to BT709 and outputs luminance-linear color-converted output data 3 (post-color-converted data) obtained by the conversion. Details of configuration of the color conversion processor 200 is described later.

The gamma corrector 300 corrects the gamma properties of the color-converted output data 3 and outputs an output image signal 4 obtained by the correction. The thus-generated output image signal 4 is outputted to a display device (e.g., display provided with display panel) directly or after being converted into a predetermined digital image transmission format. The input image signal 1, the color conversion input data 2, the color-converted output data 3, and the output image signal 4 are gradation data in which each of the color components R (red), G (green), and B (blue) is expressed by gradation of, for example, 8-bit (0 to 255) width. However, such a bit width depends on the configuration of the image signal converter 10 and the accuracy of computation performed on the color components. Thus, in this specification, the RGB gradation data is expressed by real numbers standardized as 0.0 to 1.0 without considering about the bit width. In the following descriptions, the data of R, and B is collectively referred to as the RGB gradation data or simply as "RGB data (color data)."

Embodiment 1

(Hardware Configuration Example of Color Conversion Processor)

Figure 2:
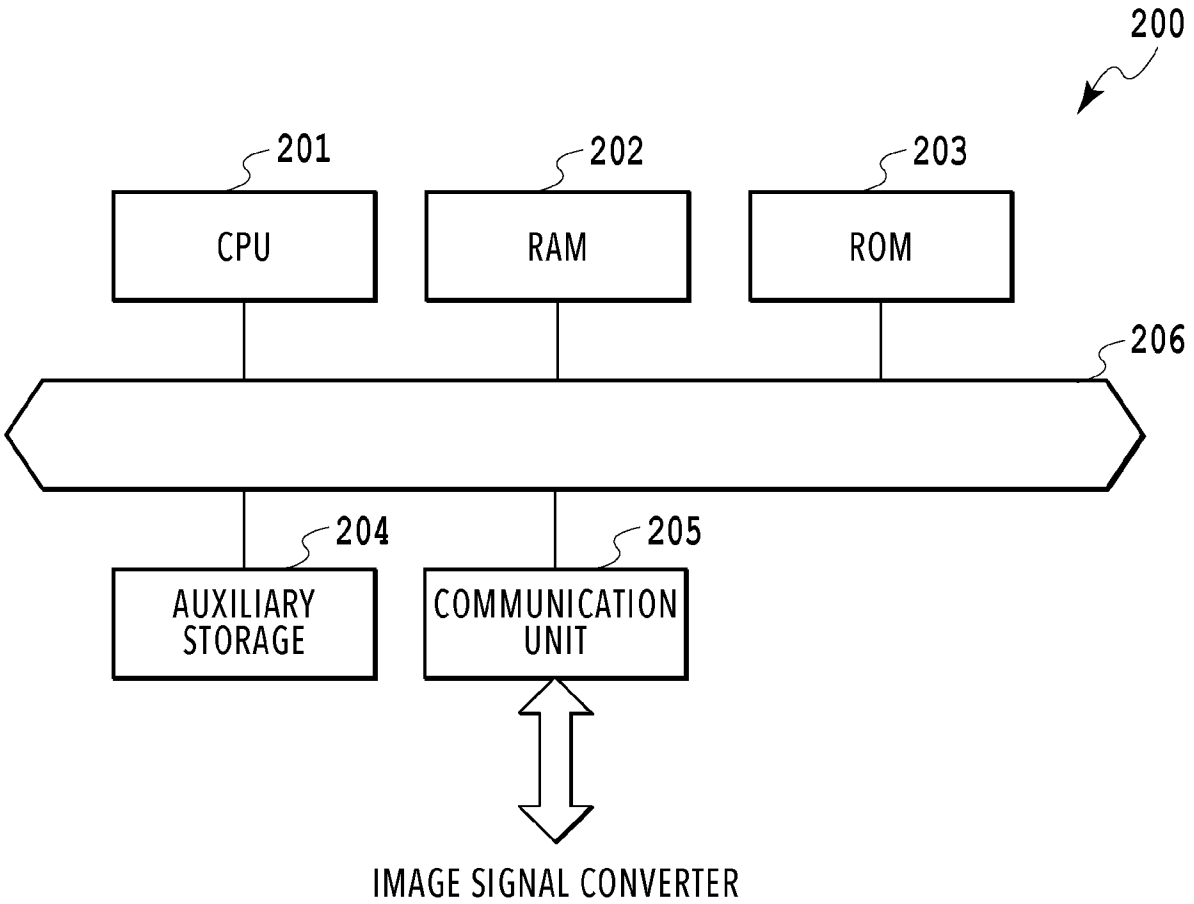
FIG. 2 is a diagram that illustrates a hardware configuration example of a color conversion processor of Embodiment 1.

FIG. 2 is a block diagram that illustrates a hardware configuration example of the color conversion processor 200 of this embodiment. The color conversion processor 200 includes a CPU 201, a RAM 202, a ROM 203, an auxiliary storage 204, and a communication unit 205, and these are communicably connected with each other via an interconnector 206. The CPU 201 is formed of an arithmetic circuit and controls the entirety of the color conversion processor 200. The CPU 201 reads a program stored in the ROM 203 out to the RAM 202 and executes various kinds of processing. The ROM 203 stores system software and the like used for controlling the color conversion processor 200. The auxiliary storage 204 has a function of a storage region. The communication unit 205 mainly communicates with the image signal converter 10 under control of the CPU 201. In this embodiment, an example in which the color conversion processor 200 is a device provided with the CPU 201 as illustrated in FIG. 2 is described; however, the hardware configuration is not limited to such an embodiment. The color conversion processor 200 may be implemented by another circuit such as an ASIC or an electronic circuit, for example.

(Color Conversion Processing Procedure)

Figure 3:
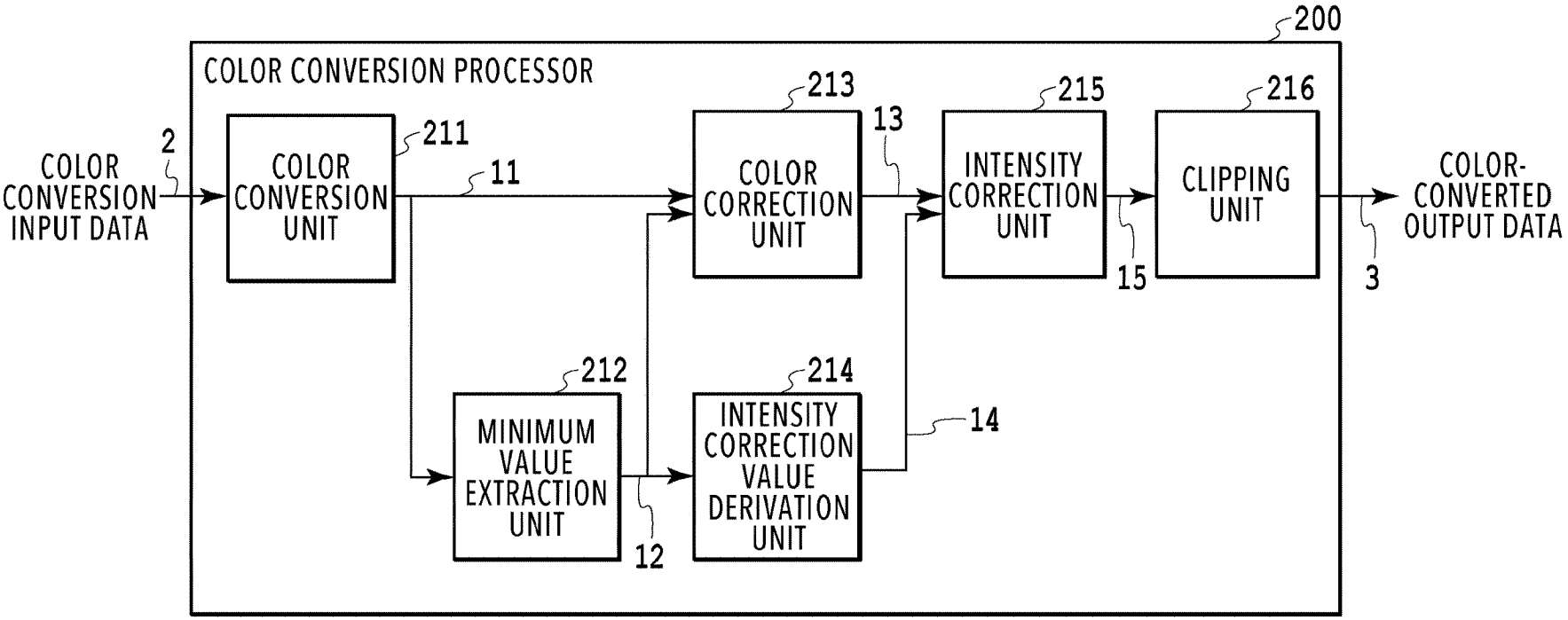
FIG. 3 is a block diagram that illustrates a functional configuration example of the color conversion processor of Embodiment 1.

FIG. 3 is a block diagram that illustrates a functional configuration example of the color conversion processor 200 of this embodiment. The color conversion processor 200 includes a color conversion unit 211, a minimum value extraction unit 212, a color correction unit 213, a luminance correction value derivation unit 214, a luminance correction unit 215, and a clipping unit 216.

Figure 4:
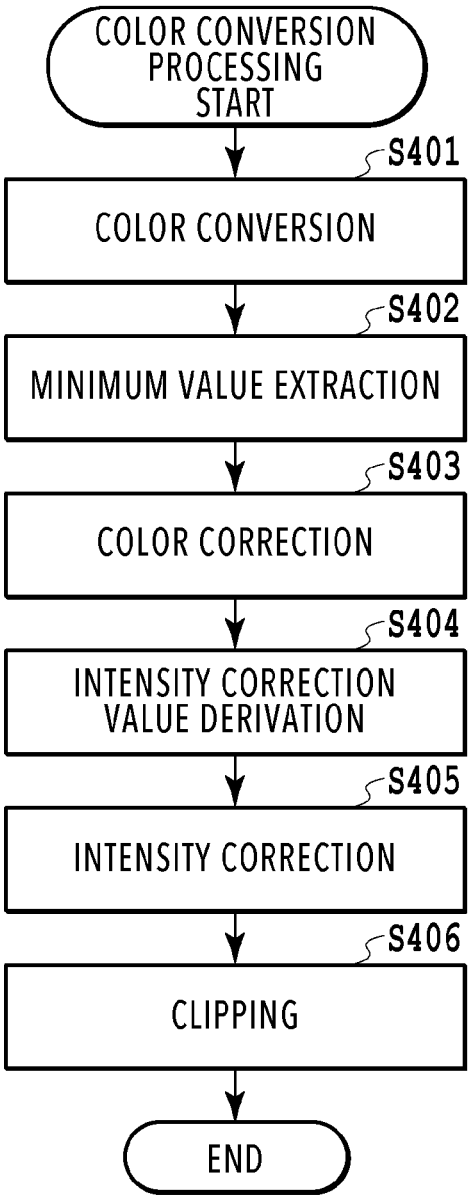
FIG. 4 is a flowchart that illustrates an example of a procedure of color conversion processing of Embodiment 1.

FIG. 4 is a flowchart that illustrates a procedure of color conversion processing of this embodiment. The processing of the flowchart illustrated in FIG. 4 is performed by the CPU 201 that decompresses a program code stored in the ROM 203 out to the RAM 202 and executes it. Otherwise, a part of or all the functions of steps in FIG. 4 may be implemented by hardware such as the ASIC or the electronic circuit. The following signs S mean the steps in the flowchart.

Hereinafter, details of the color conversion processing of this embodiment is described with reference to the functional block diagram of FIG. 3 and the flowchart of FIG. 4.

The color conversion input data 2 to be inputted to the color conversion processor 200 is, as described above, the luminance-linear RGB data compatible with the BT2020 standard. On the other hand, the color-converted output data 3 outputted from the color conversion processor 200 is the luminance-linear RGB data compatible with the BT709 standard, on which color conversion is performed by the color conversion processor 200.

In S401, the color conversion unit 211 performs color conversion using matrix computation on the color conversion input data 2 (subscript: data2) and outputs color-converted data obtained by the computation. Note that, because the RGB data will be further changed after S401, the converted data is described as provisional color-converted data 11 (subscript: data11) outputted from the color conversion unit 211. A specific example of a computing equation for obtaining the provisional color-converted data 11 from the color conversion input data 2 is expressed by Equation 1:

$$\begin{pmatrix} R_{data11} \\ G_{data11} \\ B_{data11} \end{pmatrix} = \begin{pmatrix} 1.660 & -0.588 & -0.073 \\ -0.125 & 1.133 & -0.008 \\ -0.018 & -0.101 & 1.119 \end{pmatrix} \begin{pmatrix} R_{data2} \\ G_{data2} \\ B_{data2} \end{pmatrix}. \quad \text{(Equation 1)}$$

For example, when the color conversion input data 2 is the pure color of G (green), Rdata2=0, Gdata2=1.0, and Bdata2=0, and as a result of the computation according to Equation 1, Rdata11=−0.588, Gdata11=1.133, and Bdata11=−0.101 are obtained.

Figure 5A:
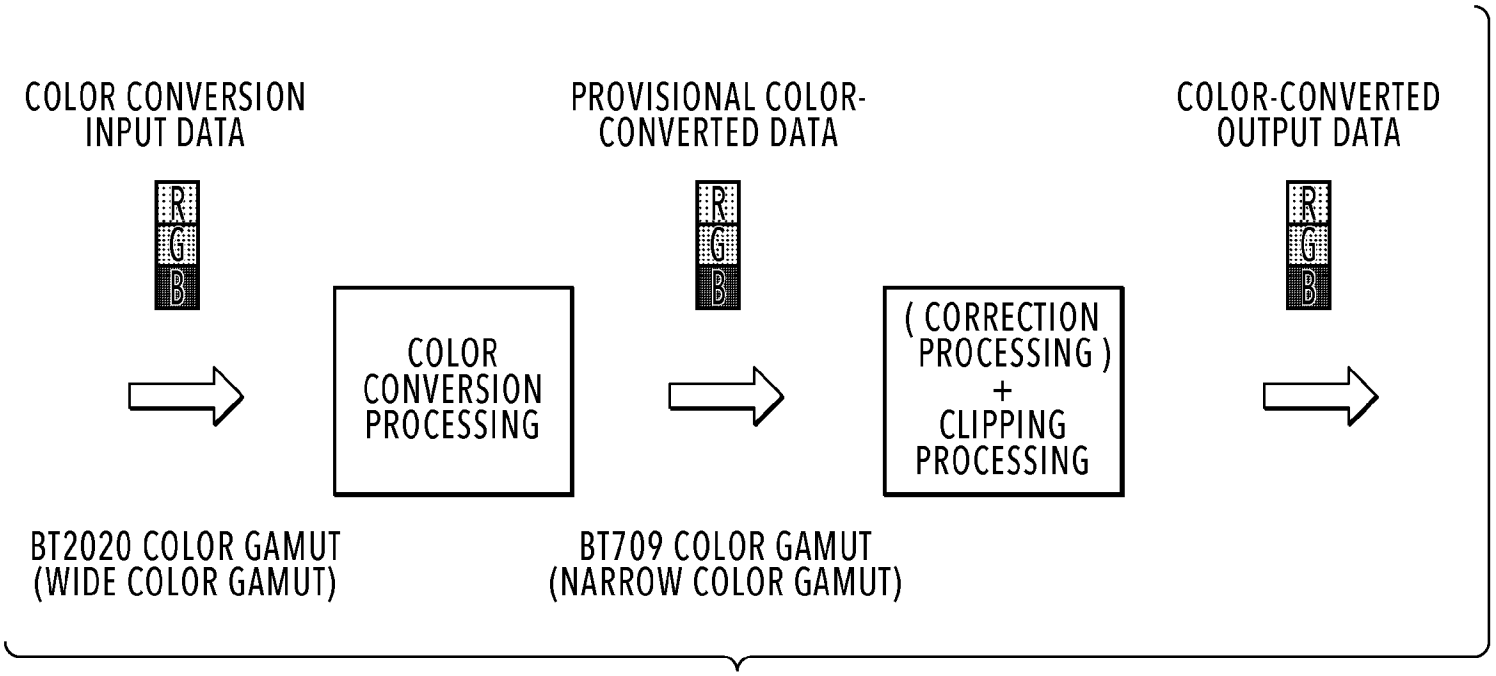
FIG. 5A is a schematic diagram that illustrates a situation in which the color conversion processing of an embodiment is performed.
Figure 5B:
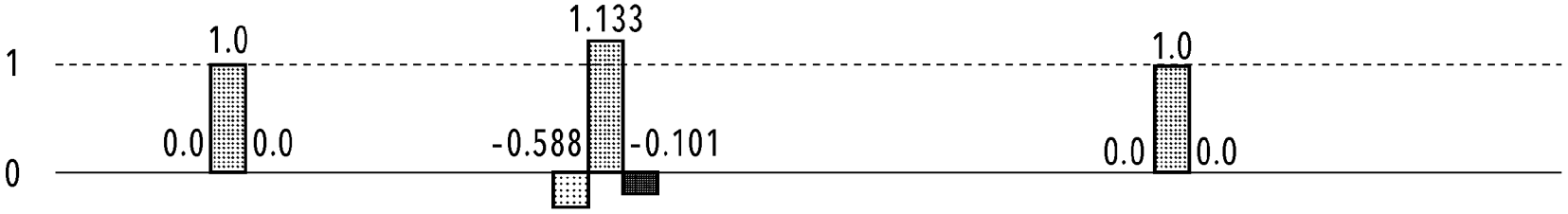
FIG. 5B is a schematic diagram that illustrates an example of transition of RGB data of a comparative example.

FIG. 5A is a schematic diagram that illustrates a situation in which the color conversion processing is performed on the BT2020 standard color conversion input data 2 and the BT709 standard color-converted output data 3 is outputted. FIG. 5B is a schematic diagram that illustrates an example of transition of the color conversion input data 2 of a comparative example. FIG. 5B illustrates a situation in which, as a result of performing the computation according to Equation 1 on the color conversion input data 2, the provisional color-converted data 11 of Rdata11=−0.588, Gdata11=1.133, and Bdata11=−0.101 is outputted. At this time, if at least any data of the RGB data exceeds 1.0 or if at least any data of the RGB data falls below 0.0, the RGB data cannot express colors of the BT709 standard any more. To deal with such range over, the easiest way may be clipping of the RGB data. In the above example of the color conversion processing, clipping processing of the RGB data makes it possible to limit the value of the RGB data greater than 1.0 to be 1.0 while limiting the value of the RGB data smaller than 0.0 to be 0.0, and thus the RGB data can be expressed with the BT709 standard.

FIG. 5B schematically illustrates a situation in which, as a result of performing the clipping processing on the provisional conversion data 11, the color-converted output data 3 of Rdata3=0, Gdata3=1.0, and Bdata3=0 is outputted. However, the balance (ratio) of the color component values in the RGB data of this color-converted output data 3 is changed from that of the provisional color-converted data 11. This means that the shade (hue) of a picture expressed by the color-converted output data 3 is changed from the shade of a picture expressed by the provisional conversion data 11.

Therefore, in the color gamut conversion of this embodiment, the hue is saved by performing the following computation.

Figure 5C:
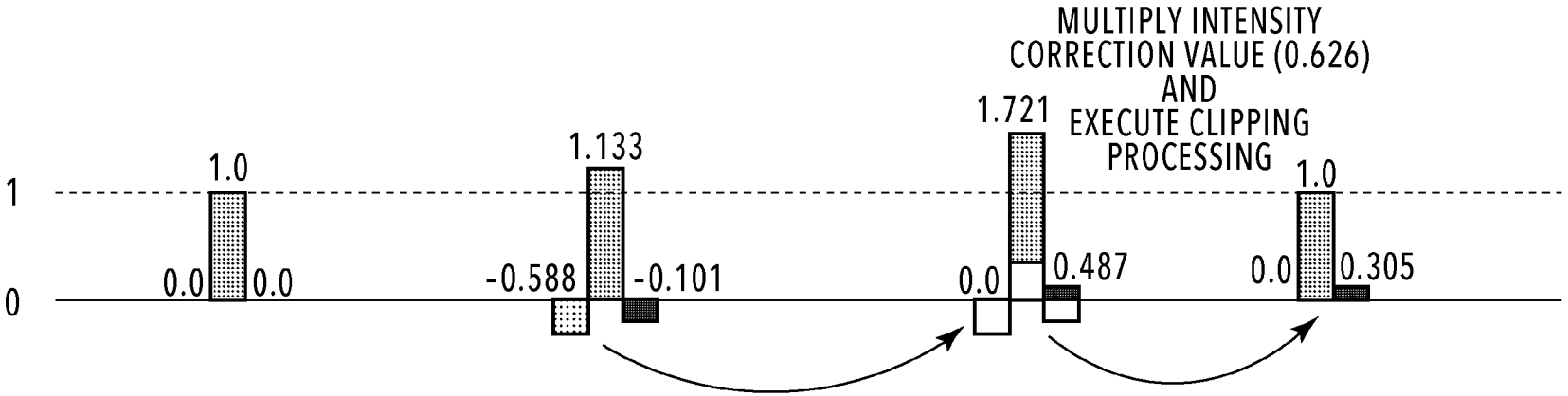
FIG. 5C is a schematic diagram that illustrates an example of transition of RGB data of Embodiment 1.

In S402, the minimum value extraction unit 212 extracts the negative minimum color component value from the RGB data of the provisional color-converted data 11 and outputs the minimum value obtained by the extraction as a minimum value 12 (hereinafter referred to as "MINdata12"). For example, when the color conversion input data 2 is the pure color of Rdata11=−0.588 is the negative minimum color component value; thus, MINdata12=−0.588 is extracted as the minimum value 12. This minimum value is varied depending on a value of the provisional color-converted data 11 and is used as a variable in the following computation. When no negative value is in the provisional color-converted data 11, the minimum value 12 is set as MINdata12=0, and processing of S403 to S404 may be skipped. FIG. 5C is a schematic diagram that illustrates an example of transition of the color conversion input data 2 of this embodiment. FIG. 5C schematically illustrates a situation in which Rdata11=−0.588 is extracted as MINdata12=−0.588 from the provisional color-converted data 11.

In S403, the color correction unit 213 uses the minimum value 12 to correct the provisional color-converted data 11. Specifically, the color correction unit 213 performs offset processing on the provisional color-converted data 11 and obtains color-corrected data 13 (subscript: data13) obtained by the offset processing. A specific example of a computing equation for obtaining the color-corrected data 13 from the provisional color-converted data 11 is expressed by Equation 2:

$$\begin{pmatrix} R_{data13} \\ G_{data13} \\ B_{data13} \end{pmatrix} = \begin{pmatrix} R_{data11} - MIN_{data12} \\ G_{data11} - MIN_{data12} \\ B_{data11} - MIN_{data12} \end{pmatrix}. \quad \text{(Equation 2)}$$

For example, when the color conversion input data 2 is the pure color of G, of the following color-corrected data 13 is obtained by the computation according to Equations 1 and 2. That is, Rdata13=−0.588−(−0.588)=0, Gdata13=1.133−(−0.588)=1.721, and Bdata13=−0.101−(−0.588)=0.487. FIG. 5C schematically illustrates a situation in which Rdata13=0, Gdata13=1.721, and Bdata13=0.487 are outputted as a result of the offset processing according to Equation 2.

As described above, subtraction of the minimum negative value of the RGB data from the provisional color-converted data 11 makes it possible to eliminate the range over on the negative side, which is generated due to the color conversion (S401). This processing can be said as offsetting of the color component values of the RGB data by the same degree of gradation. More specifically, this offset processing corresponds to adding of a white (or gray) shade to all the color component values of the RGB data, and this achieves an effect of desaturation while maintaining the hue of the provisional color-converted data 11. However, it should be noted that, since this offset processing increases the luminance of the picture expressed by the RGB data, it is required to reduce this luminance increase.

In S404, based on the minimum value 12, the luminance correction value derivation unit 214 derives a luminance correction value 14 (ALPHAdata14) corresponding to the color-corrected data 13. Here, calculation for obtaining the luminance correction value 14 is described. First, an example of a computing equation using the minimum value 12 as a correction value for the RGB data that can reduce the luminance increase is expressed by Equation 3:

$$ALPHA_{data14} = \frac{W_y}{W_y - MIN_{data12}}. \quad \text{(Equation 3)}$$

In Equation 3, Wy is a parameter for the luminance correction and is a value greater than 0. Multiplication of the computing equation expressed by Equation 3 on the RGB data makes it possible to increase the luminance while maintaining the hue. In this embodiment, Wy=1.0. However, as indicated by Equation 3, division is required for deriving the luminance correction value 14. Computational complexity of division is greater than that of addition and subtraction or multiplication. Especially when the configurations of this embodiment are implemented by the electronic circuit, division is likely to make a circuit size large. Thus, this embodiment employs a quadratic function approximation value to simplify the computation according to Equation 3. A specific example of a computing equation for obtaining the quadratic function approximation value is expressed by Equation 4:

$$ALPHA_{data14} = (ALPHA_a \cdot (-MIN_{data12}) + ALPHA_b) \cdot (-MIN_{data12}) + ALPHA_c. \quad \text{(Equation 4)}$$

Figure 6A:
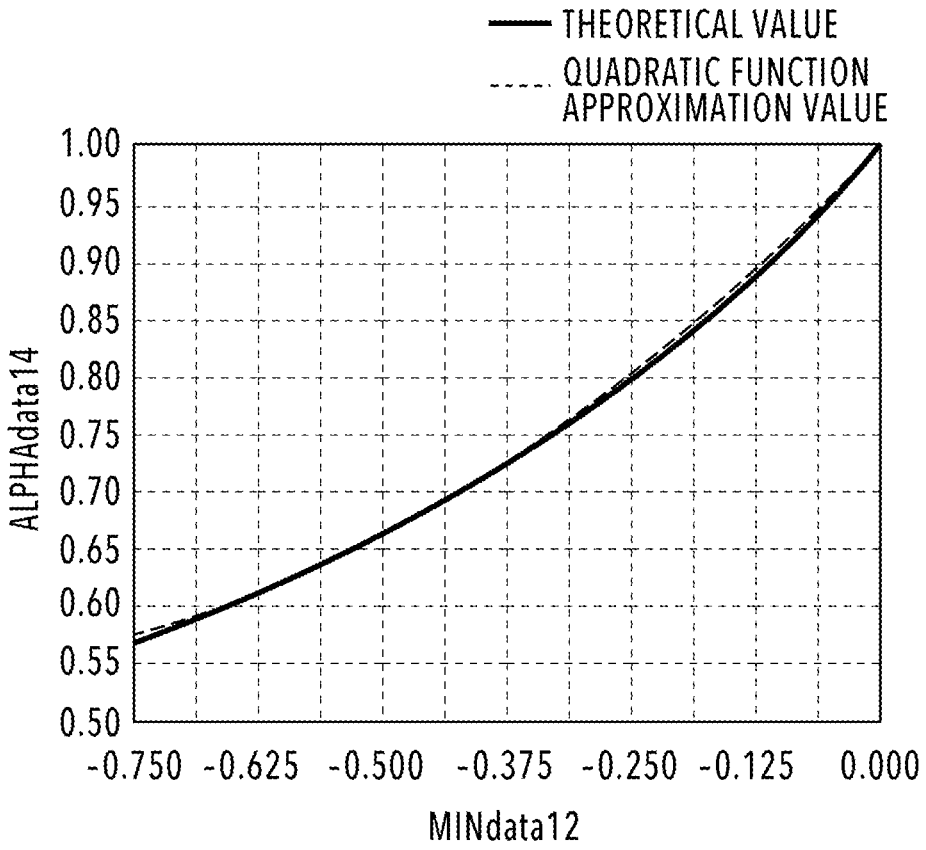
FIG. 6A is an example of a comparison diagram of a theoretical value and an approximation value of a luminance correction value of Embodiment 1.

ALPHAa, ALPHAb, and ALPHAc are coefficients used for obtaining the quadratic function approximation value. The coefficients ALPHAa, ALPHAb, and ALPHAc that can be approximated with Equation 4 are adjusted in advance. Equation 4 includes only addition and multiplication. Thus, the computational complexity of Equation 4 is less than that of Equation 3. Here, FIG. 6A illustrates comparison of a theoretical value obtained by the computation according to Equation 3 and a quadratic function approximation value obtained by the computation according to Equation 4. FIG. 6A is a graph that illustrates a relationship of the minimum value 12 and the luminance correction value 14 while the horizontal axis is the minimum value 12 and the vertical axis is the luminance correction value 14. For example, when Wy=1.0, it is possible to appropriately approximate the computation according to Equation 4 with the computation according to Equation 3 by setting ALPHAa=0.45, ALPHAb=0.9, and ALPHAc=1.0. For example, when the color conversion input data 2 is the pure color of G, the theoretical value obtained by the computation according to Equation 3 is ALPHAdata14=1/(1−(−0.588))=0.630. On the other hand, the approximation value obtained by the computation according to Equation 4 is ALPHAdata14=(0.45×(−0.588)+0.9)×(−0.588)+1.0=0.626. In this way, in this embodiment, the luminance correction value derivation unit 214 derives the luminance correction value 14 corresponding to the color-corrected data 13 by the computation of substituting the minimum value 12 into Equation 4. Although Equation 3 is also described in S404, however, the luminance correction value derivation unit 214 of this embodiment includes only the values of ALPHAa, ALPHAb, and ALPHAc and the configurations for implementing Equation 4, and does not require Equation 3 and the parameter Wy for the luminance adjustment. However, when designing the luminance correction value derivation unit 214, the coefficients used for the equation approximated with the original equation are set after the parameter Wy for the luminance adjustment for implementing desired luminance correction is adjusted.

In S405, the luminance correction unit 215 obtains luminance-corrected data 15 (subscript: data15) by multiplying the color-corrected data 13 by the luminance correction value 14. A specific example of a computing equation for obtaining the luminance-corrected data 15 is expressed by Equation 5:

$$\begin{pmatrix} R_{data15} \\ G_{data15} \\ B_{data15} \end{pmatrix} = ALPHA_{data14} \cdot \begin{pmatrix} R_{data13} \\ G_{data13} \\ B_{data13} \end{pmatrix}. \quad \text{(Equation 5)}$$

For example, when the color conversion input data 2 is the pure color of G, the following luminance-corrected data 15 is obtained by the computation according to Equation 5. That is, Rdata15=0×0.626=0, Gdata15=1.721×0.626=1.077, and Bdata15=0.487×0.626=0.305. Each color component value of the RGB data is multiplied by the luminance correction value 14; however, since any one of these color component values is certainly 0 (in the above, Rdata15=0), color component values except the color component value with the color-corrected data 13 of 0 may be multiplied by the luminance correction value 14.

In S406, the clipping unit 216 clips each color component value of the luminance-corrected data 15 so as to set each color component value to a value equal to or smaller than (or equal to or greater than) a predetermined threshold, and outputs the color-converted output data 3 obtained by the clipping. In this embodiment, in order to eliminate the range over of the luminance-corrected data 15, a value equal to or greater than 1.0 is limited to be 1.0 and a negative value smaller than 0.0 is limited to be 0.0. For example, when the color conversion input data 2 is the pure color of G, the color-converted output data 3 obtained by the clipping is Rdata3=0, Gdata3=1.0, and Bdata3=0.305. FIG. 5C schematically illustrates a situation in which the result, Rdata3=0, Gdata3=1.0, and Bdata3=0.305, is outputted after the luminance correction of the color-corrected data 13 (S405) and the clipping of the luminance-corrected data 15 (S406).

(Properties of Color Conversion Processing)

Next, color change and luminance change in this embodiment are described.

Figure 7:
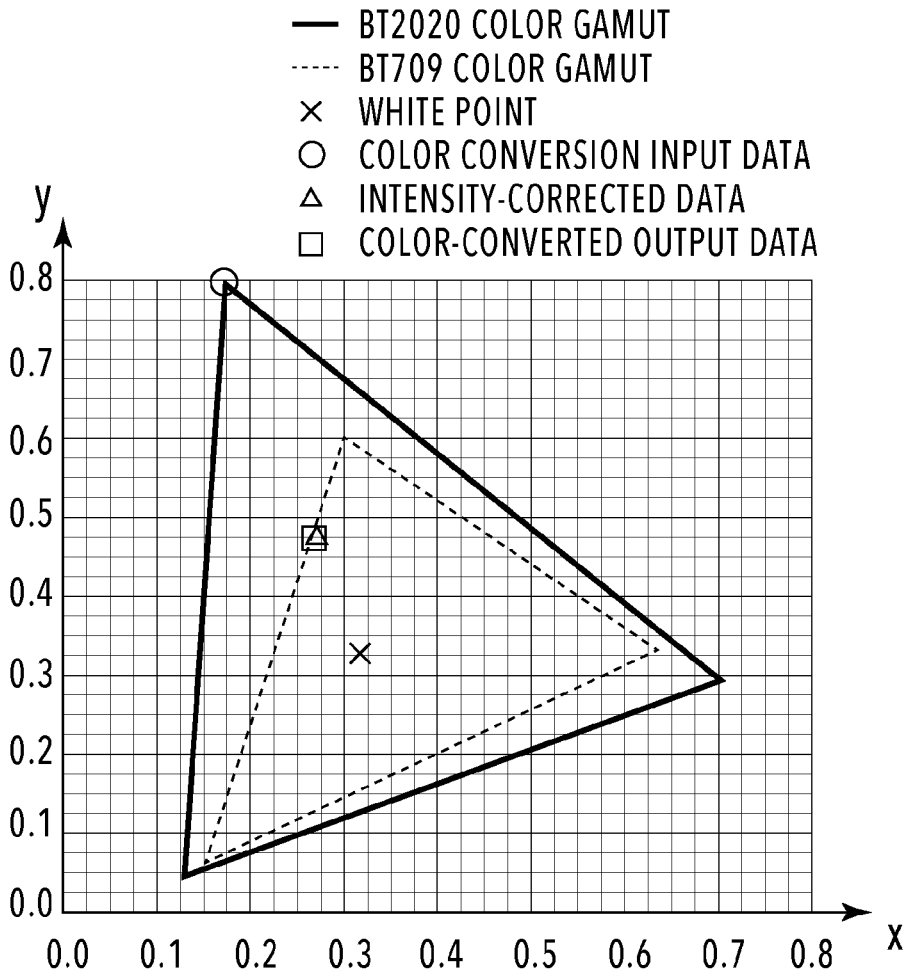
FIG. 7 is an example of chromaticity diagram indicating a range of colors expressed by color data of Embodiment 1.

FIG. 7 is a chromaticity diagram in which the horizontal axis is a value of x=X/(X+Y+Z) of the tristimulus values (XYZ) and the vertical axis is a value of y=Y/(X+Y+Z) of the tristimulus values. The chromaticity diagram of FIG. 7 illustrates a BT2020 standard color gamut (hereinafter referred to as "BT2020 color gamut") and a BT709 standard color gamut (hereinafter referred to as "BT709 color gamut"). As illustrated in FIG. 7, it can be seen that a chromaticity point indicated by the color conversion input data 2 in the BT2020 color gamut (circle in the drawing) is moved toward a chromaticity point indicated by the color-converted output data 3 in the BT709 color gamut (square in the drawing) by the color conversion processing of this embodiment. In addition, in response to the clipping, a chromaticity point indicated by the luminance-corrected data 15 before the clipping (triangle in the drawing) is moved to be close to an interunit point of a line connecting the chromaticity point indicated by the color conversion input data (circle in the drawing) and a white point (cross in the drawing) and an outermost shell of the BT709 color gamut. Although the chromaticity point indicated by the luminance-corrected data 15 (triangle in the drawing) is illustrated in the chromaticity diagram of FIG. 7, it can be seen that this chromaticity point is almost unmoved before and after the clipping in this embodiment. This embodiment is described using a case in which the color conversion input data 2 is the pure color of G as an example; however, chromaticity points of the color components other than G are also moved in the similar way. That is, in this embodiment, since the chromaticity point indicated by the color conversion input data 2 is moved based on the white point, it is possible to perform the color conversion processing from the color conversion input data 2 (color standard: BT2020) to the color-converted output data 3 (color standard: BT709) while substantially maintaining the hue of the color conversion input data 2. If the chromaticity point indicated by the color conversion input data 2 is within the BT709 color gamut, such movement of chromaticity points before and after the color conversion processing does not occur.

Meanwhile, for the color component values (RGB values), when the luminance of the color conversion input data 2 is calculated based on the Y value of the tristimulus values (XYZ), 0×0.263+1.0×0.678+0×0.060=0.678 is obtained. On the other hand, for the color component values (RGB values), when the luminance of the color-converted output data 3 is calculated based on the Y value of the tristimulus values (XYZ), 0×0.213+1.0×0.715+0.305×0.072=0.737 is obtained. As it can be seen, the color conversion processing of this embodiment has properties that the luminance is increased according to the amount of movement of the chromaticity point indicated by the color conversion input data 2 toward the chromaticity point indicated by the color-converted output data 3. Such properties can be adjusted using Wy (parameter of luminance correction).

As described above, the color conversion processor of this embodiment derives the luminance correction value 14 on which the function approximation is performed using the minimum value 12 as the variable, and uses the derived luminance correction value 14 to correct the color-corrected data 13. Thus, the color conversion processor of this embodiment can reduce the computation for the color conversion processing is performed on the color conversion input data 2 with maintaining the hue of the picture expressed by the color conversion input data 2.

Embodiment 2

In this embodiment, an example in which the linear function approximation is applied for simplifying the computation according to Equation 4 in the luminance correction value derivation (S404) is described. Descriptions of the parts common to Embodiment 1 are simplified or omitted, and unique points of this embodiment are mainly described below.

In this embodiment, a specific example of a computing equation for obtaining a linear function approximation value is expressed by Equation 6:

$$ALPHA_{data14} = ALPHA_a \cdot (-MIN_{data12}) + ALPHA_b. \quad \text{(Equation 6)}$$

Figure 6B:
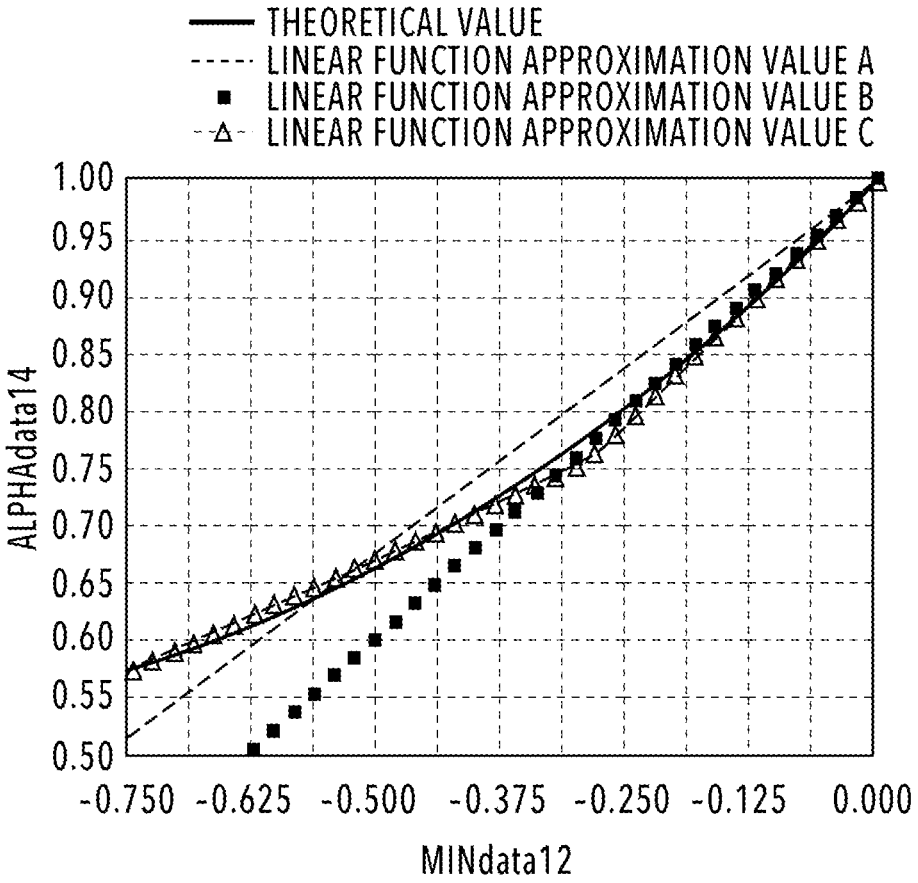
FIG. 6B is an example of a comparison diagram of a theoretical value and approximation values of a luminance correction value of Embodiment 2.

ALPHAa and ALPHAb are coefficients used for obtaining the linear function approximation value. FIG. 6B illustrates comparison of a theoretical value obtained by the computation according to Equation 3 and approximation values obtained by the computation according to Equation 6. FIG. 6B is a graph that illustrates a relationship of the minimum value 12 and the luminance correction value 14 while the horizontal axis is the minimum value 12 and the vertical axis is the luminance correction value 14.

A linear function approximation value A is for a case in which the linear function approximation is performed such that the entire region of ALPHAdata14 is approximated with the theoretical value, and the coefficients in this case are ALPHAa=0.65 and ALPHAb=1.0. A linear function approximation value B is for a case in which the linear function approximation is performed such that ALPHAdata14 is approximated with the theoretical value around MINdata12 of 0, and the coefficients in this case are ALPHAa=0.8 and ALPHAb=1.0. When the color component value to be limited is small in the clipping of the color conversion input data 2, the value of MINdata12 is a value close to 0, and this improves the approximation accuracy. A linear function approximation value C is for a case in which the approximation coefficients are varied in corresponding sections of MINdata12, and this achieves approximation using a combination of multiple linear functions. In this case, in a section where MINdata12 is (−0.3<MINdata12≤0), the coefficients are ALPHAa=0.85 and ALPHAb=1.0. In a section where MINdata12 is (MINdata12≤0.3), the coefficients are ALPHAa=0.4 and ALPHAb=0.87. As it can be seen, even when obtaining the linear function approximation value, the combination of multiple linear functions improves the accuracy of approximation with the theoretical values in the entire region of ALPHAdata14. However, when the linear function approximation value C is applied, the amount of conditional branching and coefficient data is increased; thus, the computation cost is higher than the case of applying the linear function approximation value A or B.

As described above, the color conversion processor of this embodiment derives the luminance correction value 14 using the linear function. Thus, in addition to the effects of the above embodiment, the color conversion processor of this embodiment can further reduce computational complexity and can also adjust the balance between the accuracy of the luminance correction value 14 (that is, accuracy of the color conversion processing) and the computation cost.

Embodiment 3

In this embodiment, an example in which a color matching capability is adjusted by revising the value of the minimum value 12. Descriptions of the parts common to Embodiment 1 are simplified or omitted, and unique points of this embodiment are mainly described below.

In S402, the minimum value extraction unit 212 extracts the negative minimum color component value from the RGB data in the provisional color-converted data 11. Then, the minimum value extraction unit 212 multiplies the extracted minimum value by minimum value gain and outputs the value obtained by the multiplication as the minimum value 12. For example, when the color conversion input data 2 is the pure color of G and the minimum value gain is 0.5, MINdata12=−0.588×0.5=−0.294. If no negative value is in the provisional color-converted data 11, the minimum value 12 is set as MINdata12=0, and processing of S403 to S404 may be skipped.

When the minimum value gain is 0.5, the color-corrected data 13, the luminance correction value 14, the luminance-corrected data 15, and the color-converted output data 3 are set as the following.

The color-corrected data 13 is Rdata13=−0.588−(−0.294)=−0.294, Gdata13=1.133−(−0.294)=1.427, and Bdata13=−0.101+−(−0.294)=0.193.

The luminance correction value 14 is ALPHAdata14=(0.45×(−0.294)+0.9)×(−0.294)+1.0=0.774.

The luminance-corrected data 15 is Rdata15=−0.294×0.774=−0.228, Gdata15=1.427×0.774=1.104, and Bdata15=0.193×0.774=0.149.

The color-converted output data 3 is Rdata3=0, Gdata3=1.0, and Bdata3=0.149.

(Properties of Color Conversion Processing)

Next, color change in this embodiment is described.

Figure 8:
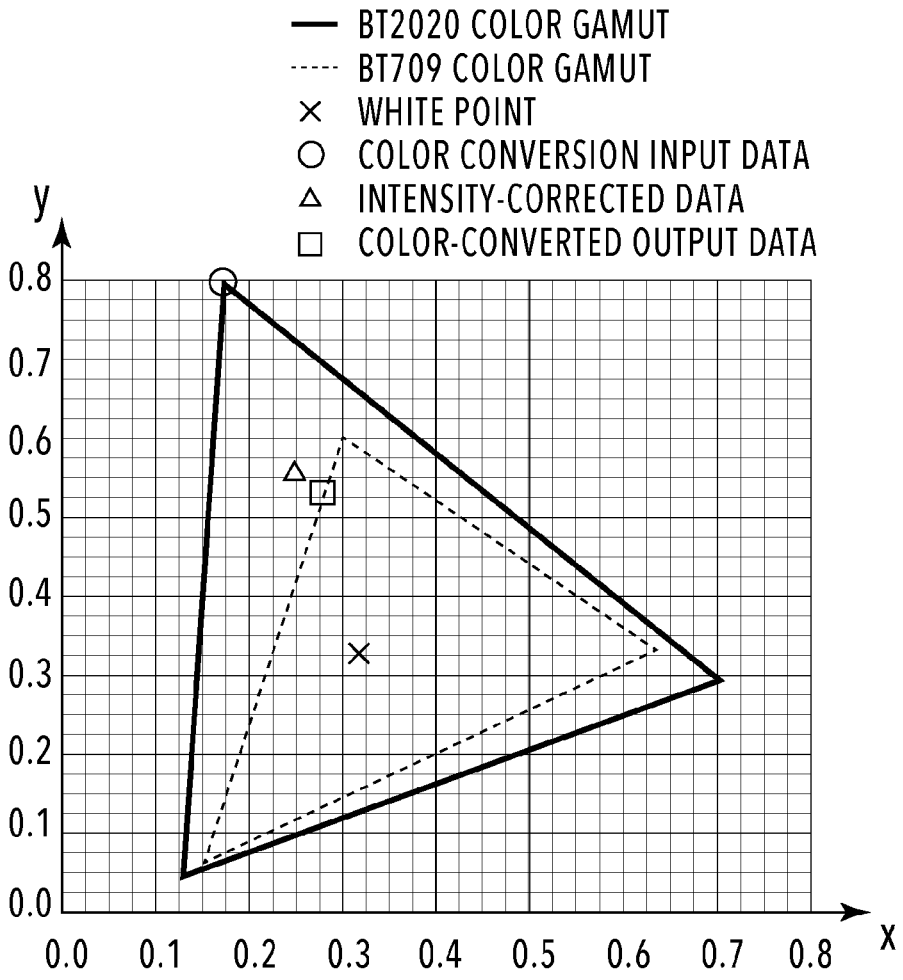
FIG. 8 is an example of chromaticity diagram indicating a range of colors expressed by color data of Embodiment 3.

FIG. 8 is a chromaticity diagram in which the horizontal axis is a value of x=X/(X+Y+Z) of the tristimulus values (XYZ) and the vertical axis is a value of y=Y/(X+Y+Z) of the tristimulus values. The chromaticity diagram of FIG. 8 illustrates the BT2020 color gamut and the BT709 color gamut. As illustrated in FIG. 8, due to the color conversion processing of this embodiment, the chromaticity point indicated by the color conversion input data 2 in the BT2020 color gamut (circle in the drawing) is moved to a position of a triangle in the drawing by the luminance correction processing (S405). It can be seen that, in response to the clipping, the chromaticity point indicated by the luminance-corrected data 15 (triangle in the drawing) is moved toward the chromaticity point indicated by the color-converted output data in the BT709 color gamut (square in the drawing). In addition, the chromaticity point indicated by the luminance-corrected data 15 (triangle in the drawing) is plotted on the straight line connecting the chromaticity point indicated by the color conversion input data 2 (circle in the drawing) and the white point (cross in the drawing).

The color conversion processing of Embodiment 1 is a use case when the minimum value gain is 1.0. In this case, the chromaticity point indicated by the luminance-corrected data 15 (triangle in the drawing) is moved to be close to the interunit point of the line connecting the chromaticity point indicated by the color conversion input data 2 and the white point (cross in the drawing) and the outermost shell of the BT709 color gamut. When the minimum value gain is greater than 1.0, the chromaticity point indicated by the luminance-corrected data 15 (triangle in the drawing) is positioned within the BT709 color gamut and is moved closer to the white point (cross in the drawing) as the value of the minimum value gain is greater. When the minimum value gain is smaller than 1.0, the chromaticity point indicated by the luminance-corrected data 15 (triangle in the drawing) is positioned outside the BT709 color gamut and is moved closer to the chromaticity point of the color conversion input data 2 (circle in the drawing) as the value of the minimum value gain is smaller.

As describe above, the color conversion processor of this embodiment can adjust the minimum value 12 with the minimum value gain. Thus, in addition to the effect of the above embodiment, the color conversion processor of this embodiment can adjust the hue (i.e., color matching capability) of the picture expressed by the color-converted output data 3.

Since the hue is not maintained before and after the clipping processing, the chromaticity point of the color-converted output data 3 illustrated in FIG. 8 (square in the drawing) is moved in a direction of the pure color of G in the BT709 color gamut. The properties may be similar to the displaying properties of the display panel compatible with the BT2020 standard. Thus, it is possible to reduce the visual difference between a case in which the color conversion input data 2 is displayed on such a display panel compatible with the BT2020 standard and a case in which the color-converted output data 3 obtained by the color conversion processing in this embodiment is displayed on a different display panel compatible with the BT709 standard.

Embodiment 4

In this embodiment, an example in which the color conversion processing is performed to the color conversion input data 2 while taking into consideration gain that is already applied. Descriptions of the parts common to Embodiment 1 are simplified or omitted, and unique points of this embodiment are mainly described below.

As already described in Embodiment 1, the luminance and the gradation of the color conversion input data 2 and the provisional color-converted data 11 have the linear relationship, and there may be a case in which the gain is applied to such gradation data. For example, it may be a case in which gradation data having RGB multiplied by the common constant is inputted for preventing generation of quantized noises in the image expressed by the gradation data. When the image processing is performed by inputting the gradation data like the image signal conversion in this embodiment, the fact that the inputted gradation data is already multiplied by the gain has to be considered.

Figure 9:
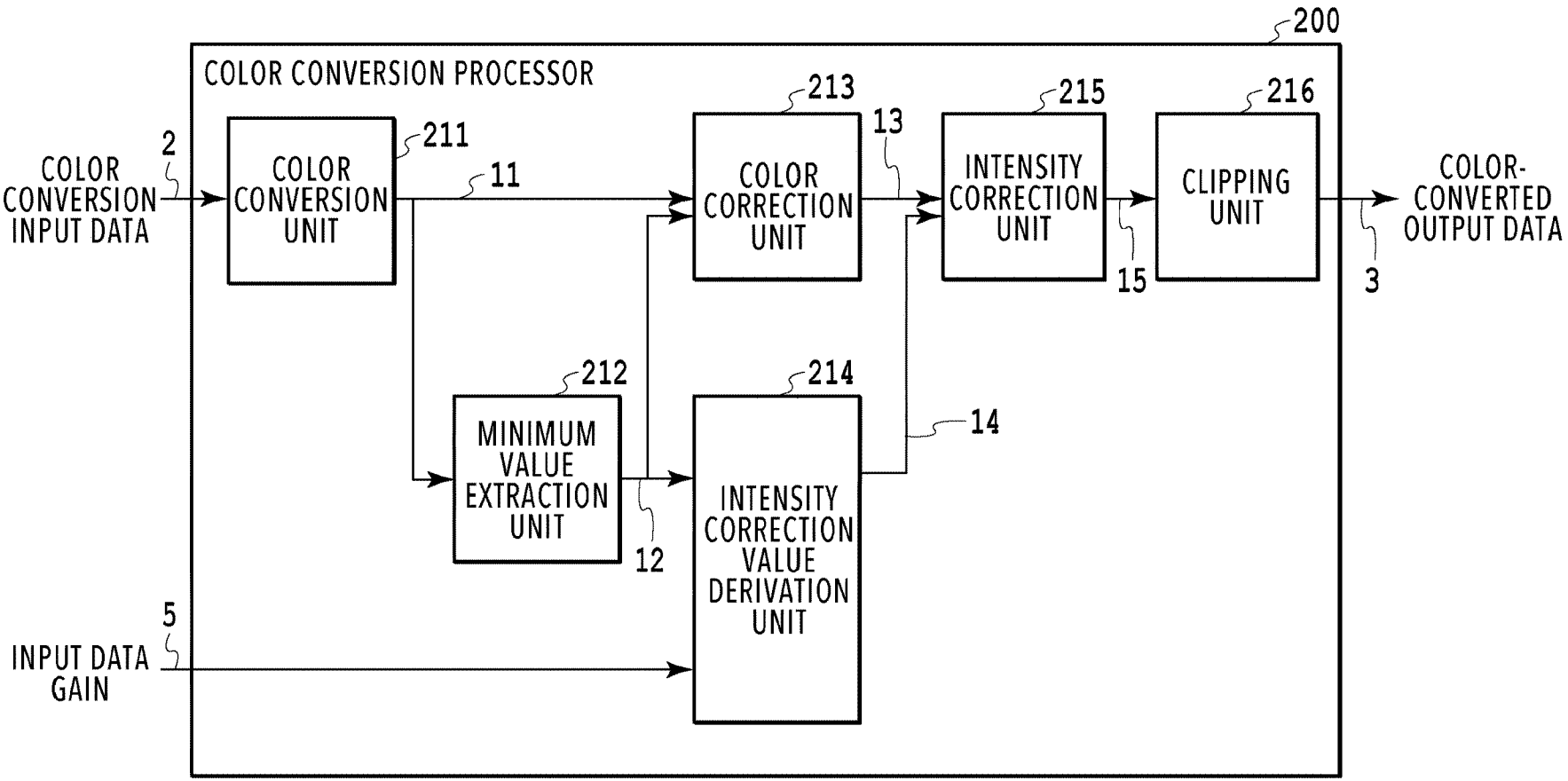
FIG. 9 is a block diagram that illustrates a functional configuration example of a color conversion processor of Embodiment 4.

FIG. 9 is a block diagram that illustrates a functional configuration example of the color conversion processor 200 of this embodiment. This color conversion processor 200 includes the same block group as the color conversion processor 200 of Embodiment 1; however, the color conversion processor 200 of this embodiment is different from the color conversion processor 200 of Embodiment 1 in that it receives input data gain 5 (GAINdata5). The input data gain 5 is inputted to the luminance correction value derivation unit 214. When the color conversion input data 2 has RGB multiplied by the common constant, a value indicated by the input data gain 5 corresponds to the common multiple applied to RGB in the color conversion input data 2. For example, if the color conversion input data 2 has RGB which is doubled, the input data gain 5 is GAINdata5=2. The luminance correction value derivation unit 214 in this embodiment derives the luminance correction value 14 based on the minimum value 12 and the input data gain 5.

A specific example of a computing equation for obtaining the luminance correction value 14 based on the minimum value 12 and the input data gain 5 is described below. For example, the luminance correction value derivation unit 214 multiplies the minimum value 12 by a reciprocal number of the input data gain 5 and further performs computation according to Equation 4 and the like on the value obtained by the multiplication to derive the luminance correction value 14. When the input data gain 5 is GAINdata5=2, MINdata12=−0.588×(½)=−0.294 is obtained. In this embodiment, the luminance correction value 14 is derived by further applying −0.294, which is obtained by the above computation, to the computation according to Equation 4.

As described above, the color conversion processor of this embodiment derives the luminance correction value 14 based on the minimum value 12 and the input data gain 5. Thus, in addition to the effects of the above embodiment, the color conversion processor of this embodiment can perform the color conversion processing while taking into consideration the gain that is already applied to the color conversion input data 2.

Other Embodiments

The configurations described in the above embodiments are only examples, and various modifications may be considered. For example, the color conversion input data 2 is compatible with the BT2020 and the color-converted output data 3 is compatible with the BT709; however, the color gamut standard is not limited thereto and it may be AdobeRGB, BT601, and so on. It should be noted that, in order to obtain the effects of the color conversion processing of this embodiment, the color gamut of the color gamut standard of the color conversion input data 2 has to be wider than the color gamut of the color gamut standard of the color-converted output data 3.

In the above embodiments, the minimum value 12 of the provisional color-converted data 11 is referred in the computation process for obtaining the luminance correction value 14 and the luminance-corrected data 15. However, when the color expressed by the input image signal is limited or when the accuracy of the color expressed by the output image signal can be allowed for a certain degree, the luminance correction value derivation (S404) and the luminance correction (S405) may be performed with reference to a predetermined value (fixed value) that is determined in advance.

The luminance correction value 14 is not necessarily be calculated using Equation 4 and the like, and processing corresponding to Equation 3 may be achieved by table reference and the like. In addition, a function for deriving the luminance correction value 14 may be a high-dimensional function other than the above-described linear and quadratic functions. In a color conversion processor having the same configuration as the above embodiments, it is possible to adjust the color matching properties by varying the matrix value used in the color conversion (S401).

In the above embodiments, only the clipping is performed on the color component value of the provisional color-converted data 11 exceeding 1.0 (when range over occurs in positive side); however, processing similar to that for the negative side case may be performed for the case of range over in the positive side. In this case, the color conversion processor 200 includes a maximum value extraction unit that extracts the maximum value from the luminance-corrected data 15, a second color correction unit that performs color correction processing using the maximum value, and a second luminance correction value derivation unit that derives a second luminance correction value to which the function approximation is performed with the maximum value as the variable. The color conversion processor 200 in this modification further includes a second luminance correction unit that performs the luminance correction processing based on second color-corrected data corrected by the second color correction unit and the second luminance correction value. Any of the maximum value extraction unit, the second color correction unit, the second luminance correction value derivation unit, and the second luminance correction unit is not illustrated.

In addition, in the above embodiments, various configurations may be appropriately combined with each other.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

The color conversion processor of the present invention can reduce computation for color conversion processing on input RGB color signals with maintaining the hue of a picture expressed by the input RGB color signals.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2018-004340, filed Jan. 15, 2018, and No. 2018-241351, filed Dec. 25, 2018, which are hereby incorporated by reference wherein in their entirety.

What is claimed is:

1. A color conversion processor, comprising:

at least one of:

one or more circuits, or one or more processors and at least one memory, the at least one memory coupled to the one or more processors and having stored thereon instructions executable by the one or more processors, wherein at least one of the one or more circuits or execution of the instructions cause the color conversion processor to function as:

a conversion unit that converts color data including a plurality of color components, which are displayable in a first color gamut, to corresponding color data in a second color gamut, which is narrower than the first color gamut;

a minimum value extraction unit that extracts the negative minimum color component value from color component values of the converted color data as a first color correction value;

a first color correction unit that corrects the converted color data by subtracting the first color correction value from each of color component values of the converted color data;

a first derivation unit that derives a first luminance correction value by multiplication and addition using the first color correction value and a plurality of predetermined coefficients; and a first luminance correction unit that corrects the color data, corrected by the first color correction unit, by using the first luminance correction value.

2. The color conversion processor according to claim 1, wherein the first derivation unit derives the first luminance correction value by performing function approximation on a predetermined function with the first color correction value as a variable, by using a function including multiplication.

3. The color conversion processor according to claim 2, wherein the function approximation is quadratic function approximation.

4. The color conversion processor according to claim 2, wherein the function approximation is linear function approximation.

5. The color conversion processor according to claim 3, wherein the function approximation has a minimum error when the first color correction value is substantially zero.

6. The color conversion processor according to claim 3, wherein the first derivation unit divides the first color correction value into a plurality of sections and performs the function approximation in each of the sections.

7. The color conversion processor according to claim 1, wherein the first derivation unit obtains the first luminance correction value by using a table storing the first color correction value calculated in advance and the first luminance correction value corresponding to the first color correction value.

8. The color conversion processor according to claim 1, wherein the first derivation unit adjusts luminance of the converted color data by adjusting a first predetermined value which is used in multiplication using the first color correction value.

9. The color conversion processor according to claim 1, wherein the first derivation unit performs function approximation on a function, which indicates that a product of a value obtained by offsetting the first color correction value from a first predetermined value which is used in multiplication using the first color correction value and the first luminance correction value is equal to the first predetermined value.

10. The color conversion processor according to claim 1, wherein the minimum value extraction unit further multiplies the extracted color component value by a first predetermined coefficient.

11. The color conversion processor according to claim 10, wherein the minimum value extraction unit adjusts the hue of the converted color data by adjusting the first predetermined coefficient.

12. The color conversion processor according to claim 1, wherein when the color data is already multiplied by a predetermined constant, the first derivation unit derives the first luminance correction value based on the extracted color component value, which is multiplied by a reciprocal number of the predetermined constant.

13. The color conversion processor according to claim 1, wherein at least one of the one or more circuits or the execution of the instructions cause the color conversion processor to further function as:

a clipping unit that performs clipping processing to limit a color component value exceeding a predetermined threshold out of color component values of the color data corrected by the first luminance correction unit to the predetermined threshold.

14. The color conversion processor according to claim 1, wherein at least one of the one or more circuits or execution of the instructions cause the color conversion processor to function as:

a maximum value extraction unit that extracts the maximum value from color component values of the color data corrected by the first luminance correction unit;

a second color correction unit that uses the maximum value to correct the color data corrected by the first luminance correction unit;

a second derivation unit that derives a second luminance correction value that allows a product of the second luminance correction value and a value obtained by correcting a second predetermined value using the maximum value to be substantially equal to the second predetermined value; and a second luminance correction unit that corrects the color data, corrected by the second color correction unit, by using the second luminance correction value.

15. The color conversion processor according to claim 14, wherein the maximum value extraction unit further multiplies the maximum value by a second predetermined coefficient.

16. The color conversion processor according to claim 14, wherein when the color data is already multiplied by a predetermined constant, the second derivation unit derives the second luminance correction value based on the maximum value, which is multiplied by a reciprocal number of the predetermined constant.

17. A method of controlling a color conversion processor, comprising:

converting color data including a plurality of color components, which are displayable in a first color gamut, to corresponding color data in a second color gamut, which is narrower than the first color gamut;

extracting the negative minimum color component value from color component values of the converted color data as a first color correction value;

correcting the converted color data by subtracting the first color correction value from each of color component values of the converted color data;

deriving a luminance correction value by multiplication and addition using the first color correction value and a plurality of predetermined coefficients; and correcting the color data, corrected by using the color correction value, by using the luminance correction value.

18. A non-transitory computer readable storage medium storing a program for executing a method of controlling a color conversion processor, the method comprising:

converting color data including a plurality of color components, which are displayable in a first color gamut, to corresponding color data in a second color gamut, which is narrower than the first color gamut;

extracting the negative minimum color component value from color component values of the converted color data as a first color correction value;

correcting the converted color data by subtracting the first color correction value from each of color component values of the converted color data;

deriving a luminance correction value by multiplication and addition using the first color correction value and a plurality of predetermined coefficients; and correcting the color data, corrected by using the color correction value, by using the luminance correction value.

* * * * *